US006273541B1

(12) United States Patent
Myung

(10) Patent No.: US 6,273,541 B1
(45) Date of Patent: Aug. 14, 2001

(54) WINDOWS DRIVER FOR SENSING INK CARTRIDGE PRIOR TO GENERATION OF DATA

(75) Inventor: Ho-Suck Myung, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/063,929

(22) Filed: Apr. 22, 1998

(30) Foreign Application Priority Data

Apr. 22, 1997 (KR) ..... 97-14827

(51) Int. Cl.[7] ..... B41J 29/393
(52) U.S. Cl. ..... 347/19
(58) Field of Search ..... 395/109; 358/1.9, 358/1.11, 1.8; 347/57, 9, 12, 49, 19

(56) References Cited

U.S. PATENT DOCUMENTS

| | | | | |
|---|---|---|---|---|
| 4,439,776 | * | 3/1984 | Zeiler | 346/75 |
| 4,833,491 | | 5/1989 | Rezanka | 346/140 |
| 4,930,915 | | 6/1990 | Kikuchi et al. | 400/175 |
| 4,968,159 | | 11/1990 | Sasaki et al. | 400/76 |
| 5,137,379 | * | 8/1992 | Ukai et al. | 400/121 |
| 5,138,344 | * | 8/1992 | Ujita | 347/14 |
| 5,146,243 | * | 9/1992 | English et al. | 347/29 |
| 5,165,014 | | 11/1992 | Vassar | 358/1.13 |
| 5,384,583 | * | 1/1995 | Katerberg et al. | 347/19 |
| 5,455,895 | | 10/1995 | Hattori | 358/1.13 |
| 5,533,175 | | 7/1996 | Lung et al. | 358/1.16 |
| 5,604,559 | * | 2/1997 | Yamanouchi et al. | 396/578 |
| 5,627,572 | | 5/1997 | Harrington, III et al. | 347/23 |
| 5,638,097 | * | 6/1997 | Takayanagi et al. | 347/19 |
| 5,640,182 | * | 6/1997 | Bahrami et al. | 347/33 |
| 5,644,682 | | 7/1997 | Weinberger et al. | 358/1.1 |
| 5,680,519 | | 10/1997 | Neff | 358/1.9 |
| 5,699,091 | * | 12/1997 | Bullock et al. | 347/19 |
| 5,731,823 | * | 3/1998 | Miller et al. | 347/5 |
| 5,732,198 | | 3/1998 | Deppa et al. | 358/1.15 |
| 5,757,395 | * | 5/1998 | Chew et al. | 347/24 |
| 5,767,872 | * | 6/1998 | Scardovi et al. | 347/19 |
| 5,997,120 | * | 12/1999 | Ohde et al. | 347/19 |

OTHER PUBLICATIONS

Notes—4833491, 4930915, 4968159, 5165014, 5455895, 5533175 5627572, 5644682, 5732198 is considered at Dec. 6, 1999.

* cited by examiner

*Primary Examiner*—David Moore
*Assistant Examiner*—King Y. Poon
(74) *Attorney, Agent, or Firm*—Robert E. Bushnell, Esq.

(57) ABSTRACT

Provided with driver operating under a Microsoft Windows operating system which senses the replacement of the ink cartridge in an automatic manner and generates a print data adapted to the type of ink cartridge in case the user replaces the ink cartridge with a pressing of an ink replacement button disposed in an inkjet printer for the user's more efficient use, the driver software performing a process including the steps of: when a new ink cartridge replaces an old ink cartridge by means of an ink replacement button, performing a first bidirectional communication for sensing the type of the ink cartridge; checking whether the ink cartridge sensed is a black one; if the ink cartridge is a black one, generating black print data according to the black ink cartridge; and if the ink cartridge is not a black one, generating color print data according to the color ink cartridge.

36 Claims, 6 Drawing Sheets

WINDOWS DRIVER FOR SENSING INK CARTRIDGE PRIOR TO GENERATION OF DATA

CLAIM OF PRIORITY

This application makes reference to, incorporates the same herein, and claims all benefits accruing under 35 U.S.C. §119 from an application entitled Windows Driver for Sensing Ink Cartridge Prior to Generation of data earlier filed in the Korean Industrial Property Office on Apr. 22, 1997, and there duly assigned Serial No. 97-14827 by that Office.

BACKGROUND OF THE INVENTION

1. Technical Field

The present invention generally relates to driver software sensing an ink cartridge prior to generation of print data and, more particularly, to driver software loaded on a host computer having a Microsoft Windows operating system which senses the replacement of the ink cartridge in an automatic manner.

2. Related Art

Computers were designed at the beginning of development to perform arithmetical and logical operations for solving complex mathematical problems in the science technology, and they have been developed for more users to utilize with ease widely. In this respect, versions of DOS (Disk Operating System) have been developed as operating systems managing the hardware and software of computers more efficiently.

After DOS was developed, Microsoft(R) Windows(R) operating systems have been developed and widely used as operating systems designed to support the graphical user interface. Microsoft Windows operating systems enable users to perform different functions simultaneously in a single computer. The Microsoft Windows operating systems also allow users to utilize the computer more easily.

With widespread use of Microsoft Windows operating systems, numerous software applications adapted for the Microsoft Windows environment have been developed, such as word processing programs, graphics editors, and others.

A computer uses driver software to link the computer to peripheral devices. Driver software is software that contains control functions enabling the computer to communicate with and also to control the peripheral devices. Peripheral devices include monitors, modems, printers, CD-ROM (compact disc read only memory) drives, and other hardware connected to the computer.

Drivers must be loaded into the computer's memory. The fundamental driver architecture is the one used by DOS (disk operating system). The way a computer handles drivers depends on the computer's operating system. DOS, 16-bit versions of Microsoft Windows operating systems, and Microsoft Windows 95 operating system each treat drivers differently.

If one wants to connect a particular printer to host computer, a device driver designed for that specific printer is needed. If the computer uses DOS (disk operating system) and does not use a Microsoft Windows operating system, then the appropriate driver for that specific printer is needed, where the driver is designed for use by computers using DOS. However, if the computer uses a Microsoft Windows operating system, such as Microsoft Windows 3.1, Microsoft Windows NT, or Microsoft Windows 95, then the appropriate device driver for that specific printer is needed, where the driver is designed for use by computers using a Microsoft Windows operating system.

Drivers match the resource needs of hardware, including the peripheral devices listed above, to the software applications used on a host computer.

Printers and printing systems have been developed to improve printing processes. Some examples of these printers and printing systems are disclosed in U.S. Pat. No. 5,732,198 for Host Based Printing System for Printing a Document Having at Least One Page issued to Deppa et al., U.S. Pat. No. 5,680,519 for Ink-Jet Printer Color Palette Selection Method and System issued to Neff, U.S. Pat. No. 5,644,682 for Method and System for Incorporating Indicia into a Document Generated by a Computer Application issued to Weinberger et al., U.S. Pat. No. 5,533,175 for Low Cost Page Printer System and Method issued to Lung et al., U.S. Pat. No. 5,455,895 for Printing Apparatus with Automatic Operation Mode Changing Function issued to Hattori, U.S. Pat. No. 5,165,014 for Method and System for Matching the Software Command Language of a Computer with the Printer Language of a Printer issued to Vassar, U.S. Pat. No. 4,968,159 for Printing Apparatus that Adapts to Host Computer's Operation Mode issued to Sasaki et al., U.S. Pat. No. 4,930,915 for Printer Having Means for Identifying Print Head Type issued to Kikuchi et al., U.S. Pat. No. 4,833,491 for Thermal Ink Jet Printer Adapted to Operate in Monochrome, Highlight or Process Color Modes issued to Rezanka, and U.S. Pat. No. 5,627,572 for Programmable Head Type Detection and Maintenance System issued to Harrington, III et al.

Currently there do exist printers and printing systems developed to improve printing processes. However, I have discovered that it would be desirable to develop an enhanced printing system where a host computer can sense the type of ink cartridge in a printer connected to the host computer in a highly effective manner.

SUMMARY OF THE INVENTION

Accordingly, the present invention is directed to driver software intended to be used in conjunction with a Microsoft Windows operating system for sensing an ink cartridge prior to generation of a print data that substantially obviates one or more of the problems due to limitations and disadvantages of the related art, to improve printing processing.

An object of the present invention is to provide a Windows driver which is designed to sense an ink cartridge replaced for the old one and then generate a print data adapted to the type of ink cartridge when the user replaces the ink cartridge with pressing an ink replacement button built.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a Windows driver performs a process including the steps of: (a) when an ink cartridge is replaced for the old one by means of an ink replacement button, performing a first bidirectional communication for sensing the type of the ink cartridge (b) checking whether the ink cartridge sensed in the step (a) is a black one; (c) if the ink cartridge is the black one, generating a black print data according to the black ink cartridge; and (d) if the ink cartridge is not the black one, generating a color print data according to a color ink cartridge.

It is to be understood that both the foregoing general description and the following detailed description are exemplary and explanatory and are intended to provide further explanation of the invention as claimed.

The present invention is more specifically described in the following paragraphs by reference to the drawings attached only by way of example.

BRIEF DESCRIPTION OF THE ATTACHED DRAWINGS

A more complete appreciation of the present invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

A computer system employing a Microsoft Windows operating system will be described below in connection with the attached figures.

Figure 1:
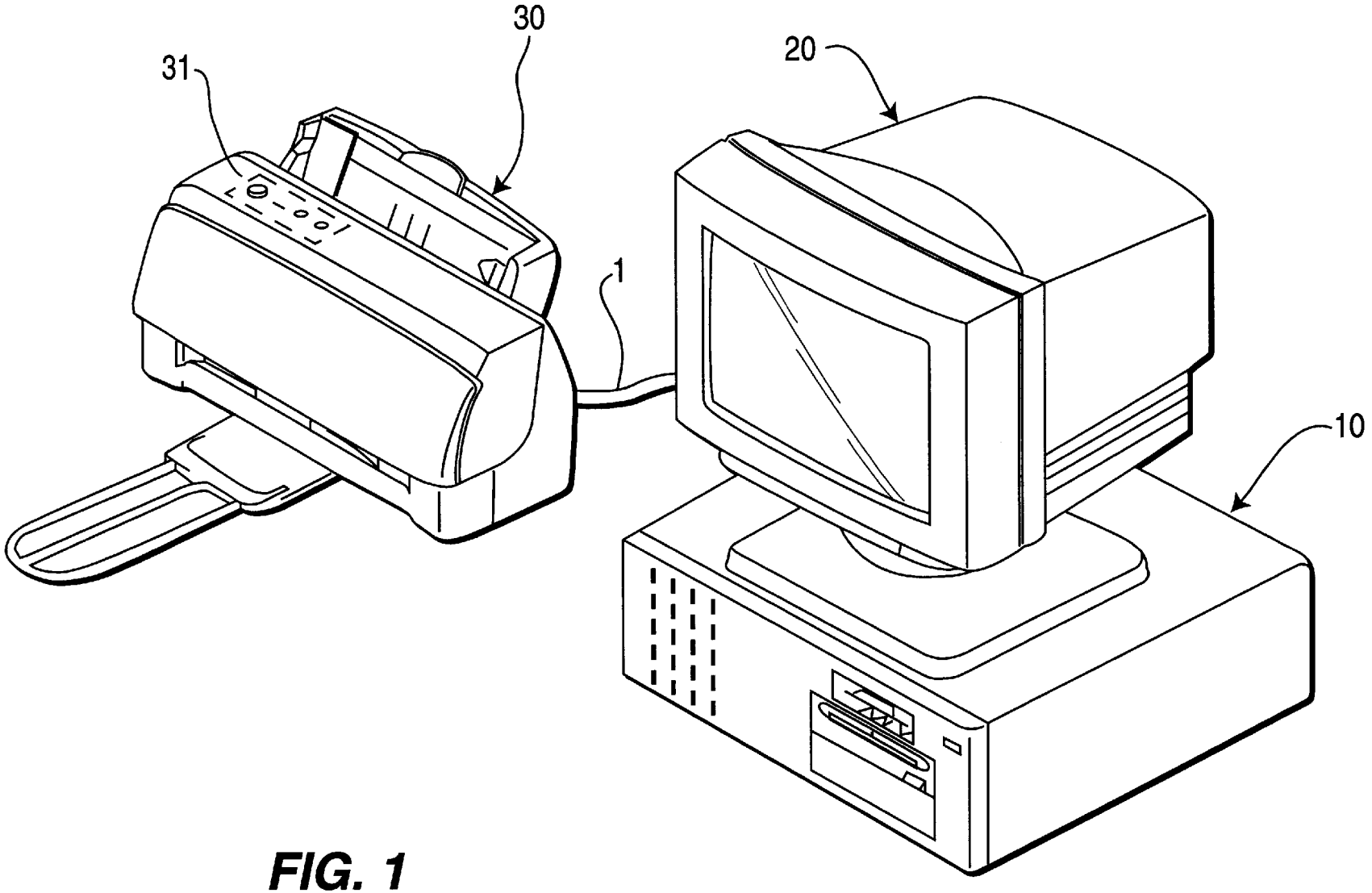
FIG. 1 is an illustration of an ink jet printer connected to a computer.

Refer now to FIG. 1, which is an illustration of an ink jet printer connected to a computer. As shown in FIG. 1, there is a computer main body 10 storing a Microsoft Windows operating system and also storing a Windows driver. The Windows driver executes a specified program to generate data associated with the program and also controls printing of the data. There is also a display monitor 20 displaying the data generated from the computer main body 10, and an ink jet printer 30 for printing the print data under the control of the Windows driver stored in the computer main body 10.

The operation in accordance with this construction is as follows. Once the user executes a software application using the computer main body 10 employing the Microsoft Windows operating system, the data produced by the software is processed into picture signals and displayed as a visual image by the display monitor 20. Using the image displayed by the monitor 20, the user can perform a desired operation.

For example, the data can be printed when the user finishes work on a word processing software application. In printing the data, the Windows driver is activated to generate the data to be printed and set all print conditions such as paper size, print direction, and print quality, and other conditions, according to the print data.

The data are compressed according to the set print conditions and are transmitted to the ink jet printer 30 through printer cable 1. The ink jet printer 30 jets ink onto the print media via an ink cartridge (not shown) in response to the print data.

Figure 2:
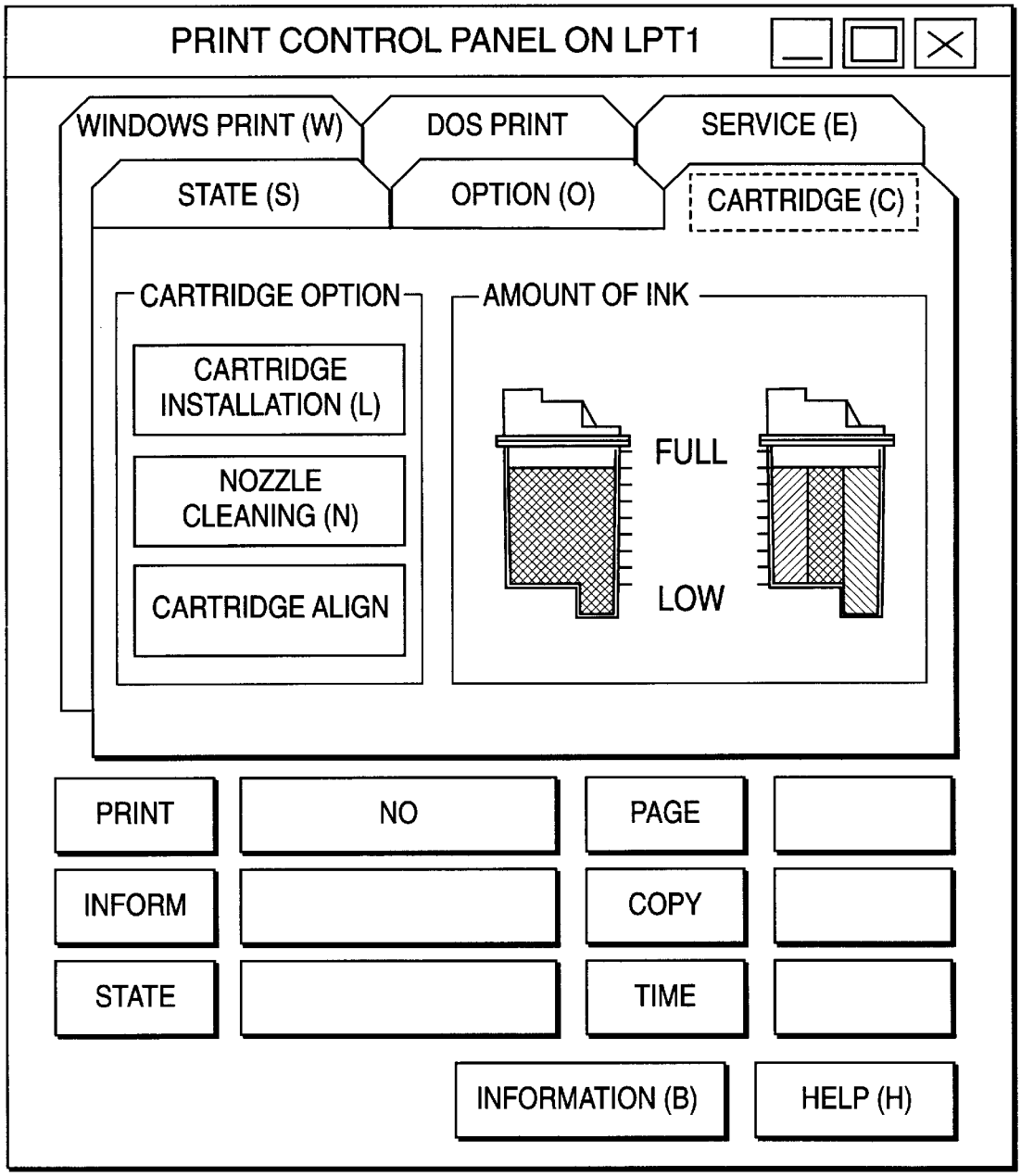
FIG. 2 is an illustration of a select button of a driver for a Microsoft Windows operating system.

Refer now to FIG. 2, which illustrates a select button of a driver for a Microsoft Windows operating system. The driver of FIG. 2 is a Windows driver. The Windows driver of FIG. 2 generates print data and controls the ink jet printer 30, wherein the print data is generated from the Windows driver and compressed by a spool manager.

Figure 3:
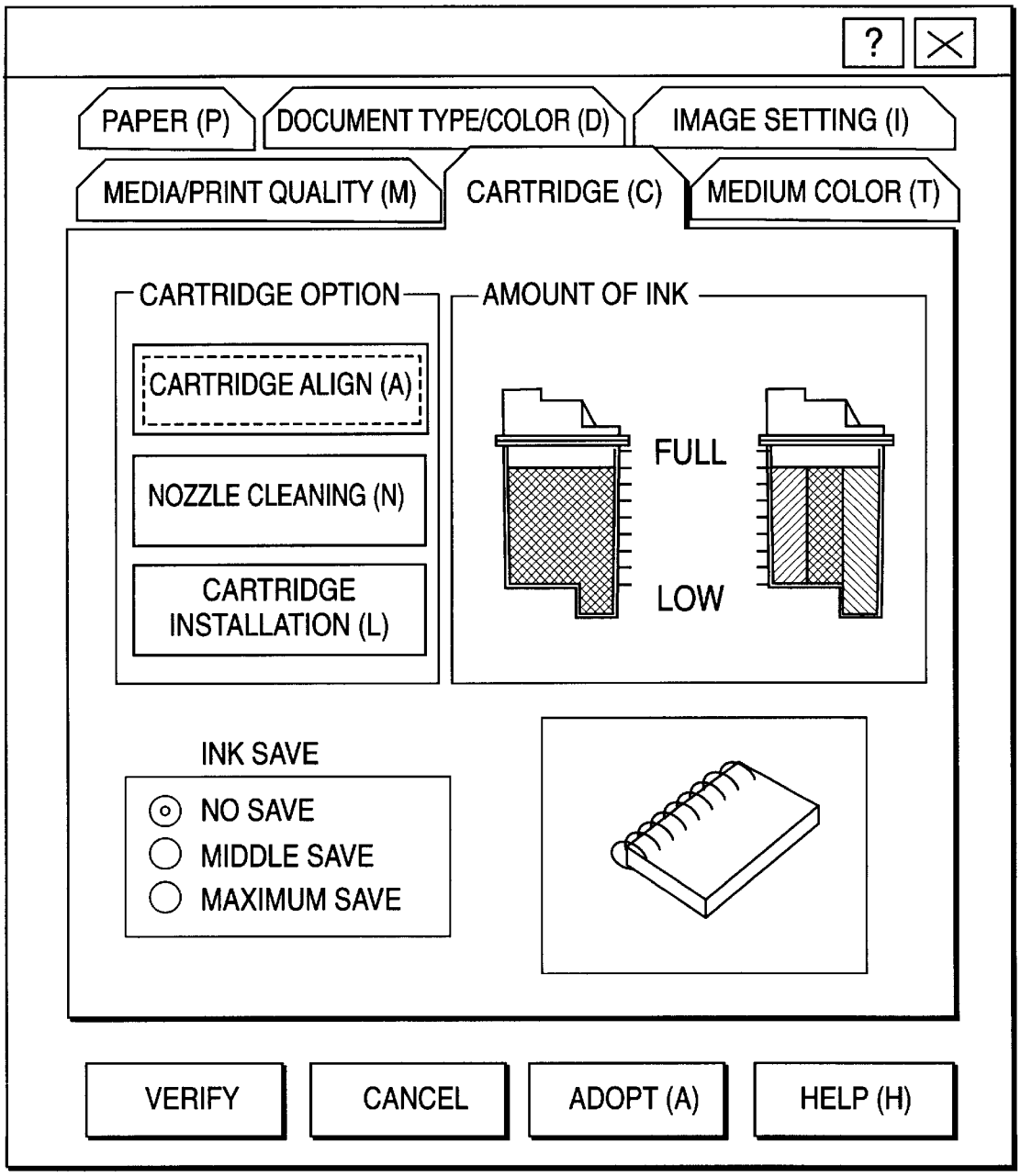
FIG. 3 is an illustration of a select button in a control panel of a driver for a Microsoft Windows operating system.

Refer now to FIG. 3, which illustrates a select button in a control panel of a driver for a Microsoft Windows operating system. The print data generated from the Windows driver (shown in FIG. 2) is decompressed through a control panel shown in FIG. 3. The Windows driver communicates bi-directionally with the ink jet printer (reference numeral 30 in FIG. 1), sensing the power ON/OFF state of the ink jet printer 30, the connection with the printer cable (reference numeral 1 in FIG. 1), and the type of ink cartridge (not shown).

Such a Windows driver (shown in FIG. 2) memorizes the type of the ink cartridge mounted in the ink jet printer (reference numeral 30 in FIG. 1) and generates a print data dependent on the type of the ink cartridge memorized.

For example, the Windows driver memorizing that the inkjet printer has a black ink cartridge generates print data based on the black ink cartridge, while it generates print data on the basis of a color ink cartridge after memorizing the color ink jet printer installed in the ink jet printer.

There are two methods of replacing an ink cartridge with another ink cartridge during generation of the print data. The first method makes use of the Windows driver (shown in FIG. 2) or control panel (shown in FIG. 3). The second method makes use of the ink replacement button (reference numeral 31 in FIG. 1) of the ink jet printer 30.

Where the Windows driver (shown in FIG. 2) or control panel (shown in FIG. 3) is used in replacing the ink cartridge, it is possible to sense the type of new ink cartridge replacing the old ink cartridge in the inkjet printer 30. However, when the ink replacement button 31 in the inkjet printer 30 is used to replace an old ink cartridge with a new ink cartridge, the type of new ink cartridge cannot be sensed until execution of the control panel (shown in FIG. 3). That is, the identification of the type of the new ink cartridge cannot be known until the Windows driver engages in bidirectional communications with the ink jet printer 30.

If the Windows driver (shown in FIG. 2) is used to print data with a black ink cartridge installed in the ink jet printer 30, for instance, the Windows driver generates black print data on the basis of the black ink cartridge and sends it to the ink jet printer 30.

However, when the user replaces the black ink cartridge with a color ink cartridge using the ink replacement button 31 of FIG. 1, disposed in the outer case of the inkjet printer 30, the Windows driver (shown in FIG. 2) does not sense the replacement of the ink cartridge. Thus, the Windows driver of FIG. 2 will generate black print data for use by a black ink cartridge.

Consequently, an error message appears. The error message appears because the Windows driver did not recognize the replacement of the ink cartridge at an appropriate time. The Windows driver did not recognize the replacement of the ink cartridge until the time bidirectional communications took place between the ink jet printer and the the control panel. The same error message also occurs when a color ink cartridge disposed in the ink jet printer 30 is replaced by a black ink cartridge using the ink replacement button 31 of FIG. 1.

The error message displayed might be, for example, "The print data is for printing in black and the color ink cartridge is in the printer. Replace the ink cartridge or cancel printing." Thus, the error message requests that the user replace the ink cartridge for example.

As described above, when the use presses the ink replacement button 31 to replace the ink cartridge, the Windows driver generates print data before sensing that the ink cartridge has been replaced, causing a print error message to appear.

Reference will now be made in detail to the preferred embodiments of the present invention, examples of which are illustrated in the accompanying drawings.

Figure 4:
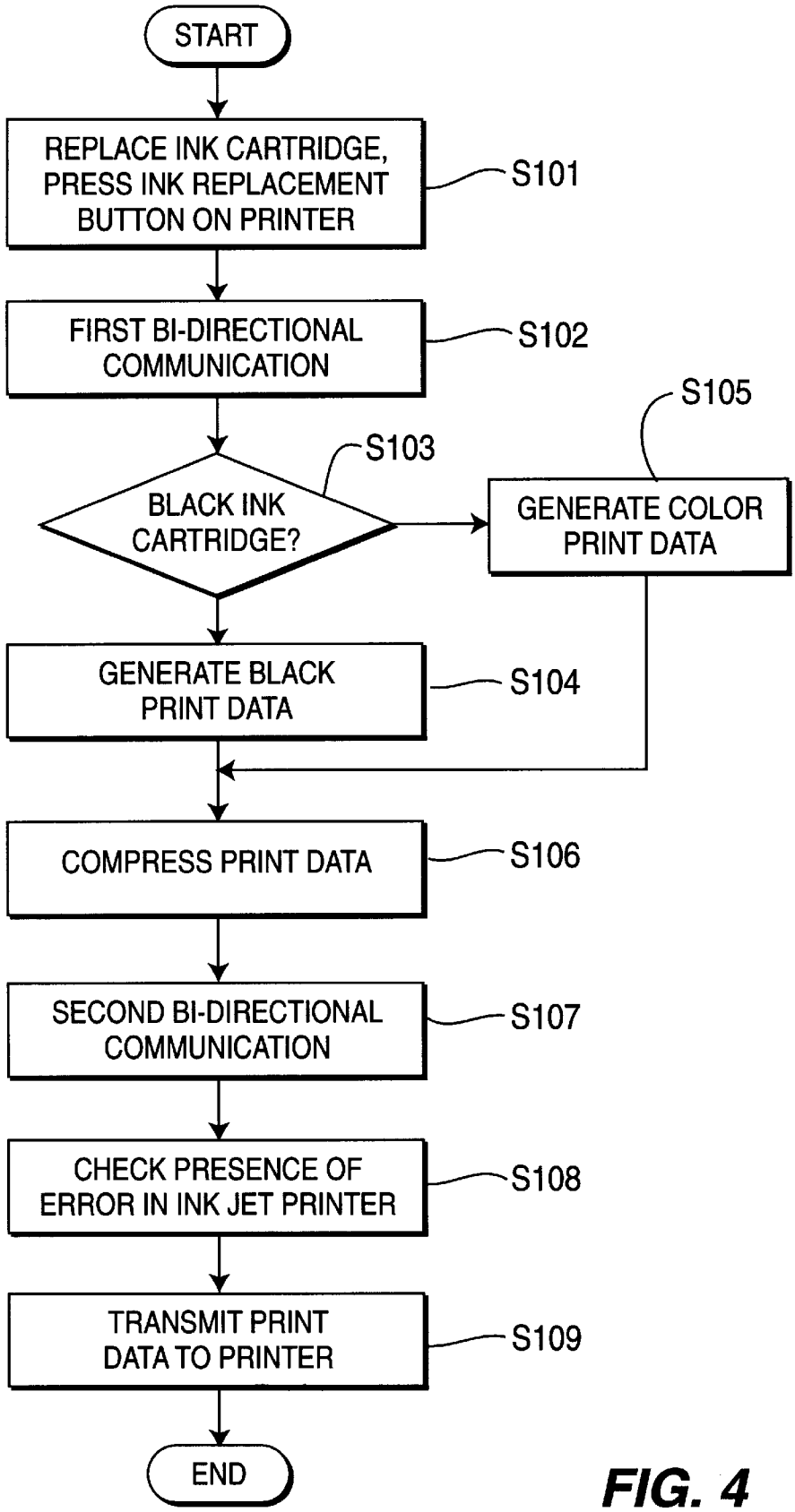
FIG. 4 is a flow chart illustrating the process of operating a driver generating print data dependent on an ink cartridge, according to the principles of the present invention.

Refer now to FIG. 4, which is a flow chart illustrating the process of operating a driver generating print data dependent on an ink cartridge, according to the principles of the present invention. In other words, FIG. 4 is a flow chart illustrating the process of executing a Windows driver generating print data dependent on an ink cartridge in an ink jet printer, according to the principles of the present invention.

At step S101, an ink cartridge is replaced by pressing an ink replacement button (reference numeral 31 in FIG. 1). At step S102, the new type of ink cartridge is sensed during a first bidirectional communication. At step S103, it is determined whether the new ink cartridge is for wherein the ink has a pigment corresponding to a black ink. At step S104, if the ink cartridge is for black ink, black print data is generated according to the black ink cartridge. Presume, for purposes of illustration, that a black ink cartridge has been replaced with a color ink cartridge in step S101. At step S105, since the ink cartridge is not for black ink, color print data is generated according to a color ink cartridge wherein the ink has a pigment corresponding to a color ink. At step S106, the color print data generated in step S105 is compressed. At step S107, print conditions are checked during a second bidirectional communication, prior to transmitting the compressed color print data. At step S108, there is a checking for the presence of an error in an ink jet printer. At step S109, print data is transmitted to the ink jet printer.

Figure 5:
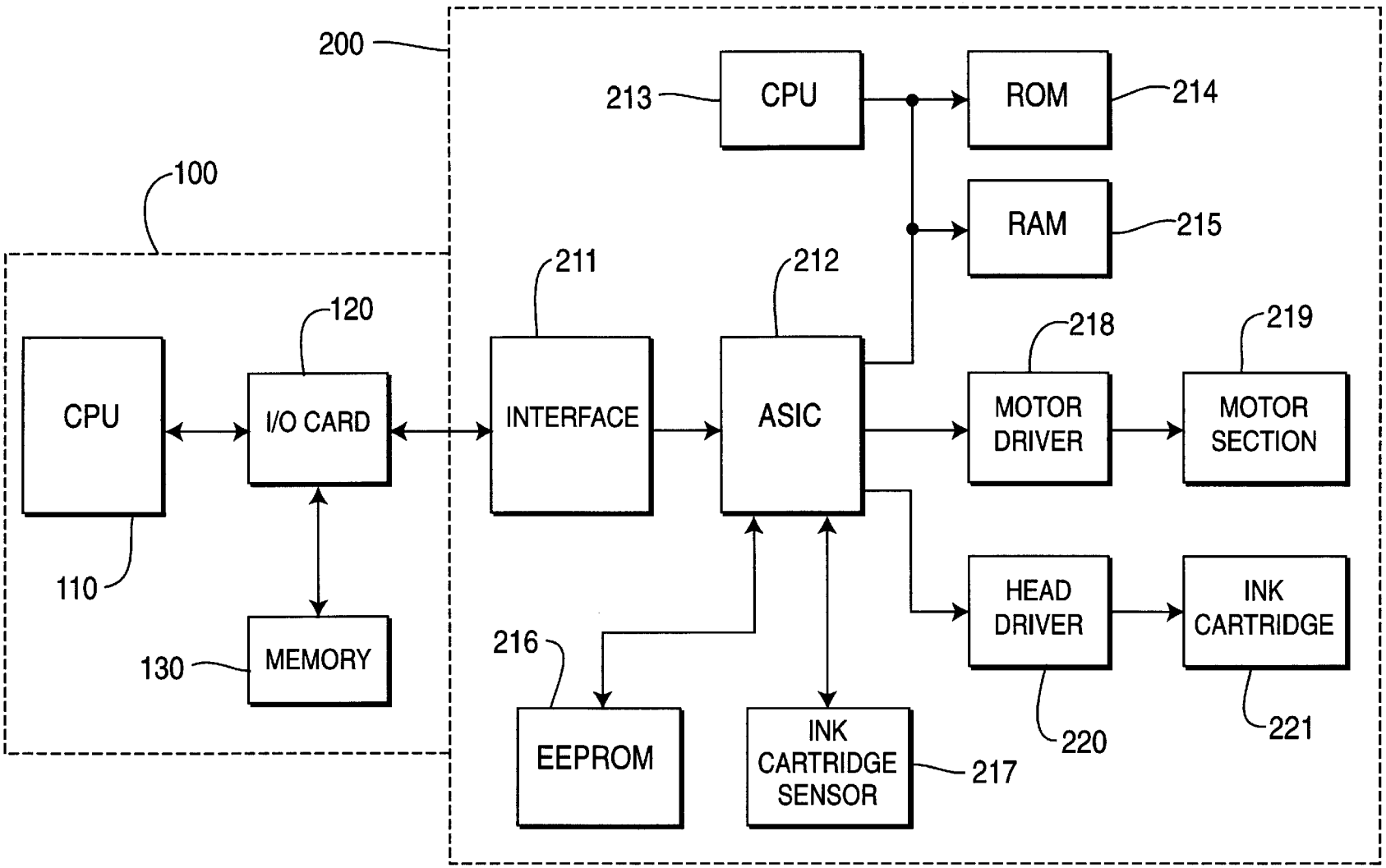
FIG. 5 is a block diagram showing the internal connections of an ink jet printer, wherein the computer stores a driver generating print data dependent on an ink cartridge, according to the principles of the present invention.

Refer now to FIG. 5, which is a block diagram showing the internal connections of an ink jet printer, wherein the computer stores a driver generating print data dependent on an ink cartridge, according to the principles of the present invention. The Windows driver of the present invention, according to the principles of the present invention, will be described in detail with reference to FIG. 5. Through the use of a Microsoft Windows operating system, a Windows driver for ink jet printer 200 is installed in a computer 100 and stored in a memory 130. The computer 100 is running a Microsoft Windows operating system and can be referred to as the Windows computer 100. The memory 130 stores all sorts of application software as well as the Windows driver. Upon choosing an application software that is stored in the memory 130, the computer 100 has central processing unit (CPU) 110 load the software application.

The user turns on the power for the ink jet printer 200 in order to print the output data attendant to execution of the software application. If the user applies the power to 1-pen type ink jet printer 200, CPU 213 of the ink jet printer 200 loads the data through EEPROM (electronically erasable programmable read only media) 216 storing the initial conditions, causing initialization of the ink jet printer 200 under the control of the control program stored in ROM (read only memory) 214. RAM (random access memory) 215 temporarily stores the data generated from the CPU 213 of the ink jet printer 200.

After the completion of initialization of the ink jet printer 200, the user selects the print of output data through computer 100. A spool manager of the Windows driver compresses the print data attendant to execution of an application software in printing the data.

The control panel of the Windows driver checks the state of the ink jet printer 200. The Windows driver then decompresses the print data and transmits it to interface 211 of the ink jet printer 200 via I/O (input/output) card 120 of the computer 100.

The print data is applied to an ASIC (application specific integrated circuit) 212 via the interface 211 of the ink jet printer 200 and sent to the CPU 213, so that the CPU 213 of the ink jet printer 200 loads a font data stored in the ROM 214 in response to the print data, generating a print control signal.

The print control signal generated from the CPU 213 is applied to a motor driver 218 and a head driver 220 through the ASIC 212. The motor driver 218 generates a motor drive signal in response to the print control signal sent from the ASIC 212.

Motor section 219 rotates in response to the motor drive signal from the motor driver 218, causing a rotational force. For example, the rotational force is imposed on a motor (not shown) for reciprocating ink cartridge 221 and a motor (not shown) for transferring the print media.

Further, the head driver 220 which has received the print control signal from the ASIC 212 generates an electrical signal to the ink cartridge 221 in response to the print control signal. Under the receipt of the electrical signal, the ink cartridge 221 jets ink onto the print media, producing an image.

To generate a black print data with a color ink cartridge used, the user presses the ink replacement button (reference numeral 31 in FIG. 1). That is, the user replaces the color ink cartridge with a black one by pressing the ink replacement button 31 disposed in the outer case of the inkjet printer 200 in step S101.

The black cartridge replaced for the color one in step S101 is sensed through a first bidirectional communication in step S102. More particularly, the Windows driver requires the ink jet printer 200 to send information pertaining to an ink cartridge before the Windows driver generates print data. The signal requesting the sensing of the ink cartridge is generated from the Windows driver installed in the memory 130 of the computer 100 and applied to the ink jet printer 200 via the I/O card 120 under the control of the CPU 110 in the computer 100.

This request signal is sent to the ASIC 212 through the interface 211 of the inkjet printer 200 and further to the CPU 213.

CPU 213 generates a control signal for sensing the ink cartridge in response to the request signal received from the ASIC 212, and the control signal is sent to an ink cartridge sensor 217 via the ASIC 212. The ink cartridge sensor 217 is to sense the type of ink cartridge 221 replaced in the ink jet printer 200.

In sensing the ink cartridge 221, the ink cartridge sensor 217 discriminates the type of ink cartridge 221 from the difference in the number of nozzles between the black ink cartridge and the color one. That is, as the black ink cartridge has 56 nozzles and the color one has 48 nozzles, the type of ink cartridge 221 is discriminated from the difference in number, eight nozzles, and the 48 nozzles common in two ink cartridges.

The ink cartridge sensor 217 generates an ink cartridge sensing signal to the ASIC 212, which sends the signal to the computer 100 through a printer cable enabling a bidirectional communication via the interface 211 of the ink jet printer 200.

I/O card 120 of the computer 100 applies the ink cartridge sensing signal to the CPU 110 in the computer 100, which processes the signal to record the type of ink cartridge 221 in the Windows driver.

Whether the ink cartridge is a black one or not is determined in step S103. If the ink cartridge is a black one, the Windows driver generates a black print data in step S104. This black print data is compressed by the spool manager in the Windows driver. Following compression of the black print data, the control panel is actuated to check the connection of printer cable 1 which is capable of bidirectional communications, in step S107. If the printer cable 1 is in normal state, the control panel checks the power of the ink jet printer 200 through the printer cable 1.

That is, the control panel of the Windows driver generates a request signal for checking the ink jet printer via the I/O card 120, and the signal is applied to the CPU 213 through the interface 211 and ASIC 212 of the ink jet printer 200.

CPU 213 generates a data relating to the current state of the ink jet printer 200 in response to the request signal, the output data being sent to the computer 100 through ASIC 212 and interface 211. CPU 110 of the computer 100 receives the data indicating the current state of the inkjet printer 200, checking the presence of an error in the ink jet printer 200 in step S108.

The result of step S108 is stored in the control panel of the Windows driver, and the Windows driver decompresses the print data in response to the data relating to the state of the ink jet printer 200, generating the print data through the I/O card 120. When the ink jet printer 200 is in the normal state, print operation is well finished in step S109.

That is, the print data generated from the I/O card 120 of the computer 100 is applied to the interface 211 of the ink jet printer 200 through print cable 1, and further sent to the ASIC 212. CPU 213 generates a print control signal in response to the print data sent from the ASIC 212 and applies it to the motor driver 218 and the head driver 220 via the ASIC 212. The motor driver 218 drives the motor section 219 according to the print control signal, causing generation of rotational force to transfer the print media and drive the ink cartridge 221. In response to the print control signal sent from the ASIC 212, the head driver 220 generates an electrical signal to the ink cartridge 218, so that the ink cartridge 218 jets ink onto the print media, forming an image.

Through this process, an image is printed on the media according to the print data generated from the computer 100. Once the black cartridge is replaced with the color one in step S101, the control panel of the Windows driver is put into operation for the first bidirectional communication, in step S102. The control panel generates a request signal for sensing the ink cartridge in order to discriminate the type of ink cartridge.

The request signal is applied to the I/O card 120 of the computer 100 and to the interface 211 and the CPU 213 in the ink jet printer 200 through printer cable 1. Upon receipt of the request signal for sensing the ink cartridge, CPU 213 senses the type of ink cartridge through ink cartridge sensor 217.

The ink cartridge sensing signal is sent again to the I/O card 120 of the computer 100 via the ASIC 212 and the interface 211. The I/O card 120 applies the signal to the CPU 110 of the computer 100, which determines the type of ink cartridge and stores the result in the control panel of the Windows driver. The ink cartridge 221 is recognized for its type from the data stored in the control panel, and whether the ink cartridge 221 sensed is a black one or not is checked in step S103.

If the ink cartridge is determined to be a color one in step S103, the Windows driver generates a color print data in step S105. The spool manager of the Windows driver compresses this color print data in step S106, and the state of the ink jet printer 200 is checked through the second bidirectional communication in step S107. In step S108, the Windows driver checks the presence of an error in the ink jet printer 200. When the ink jet printer 200 is in the normal state, color print operation is well finished in step S109.

Figure 6:
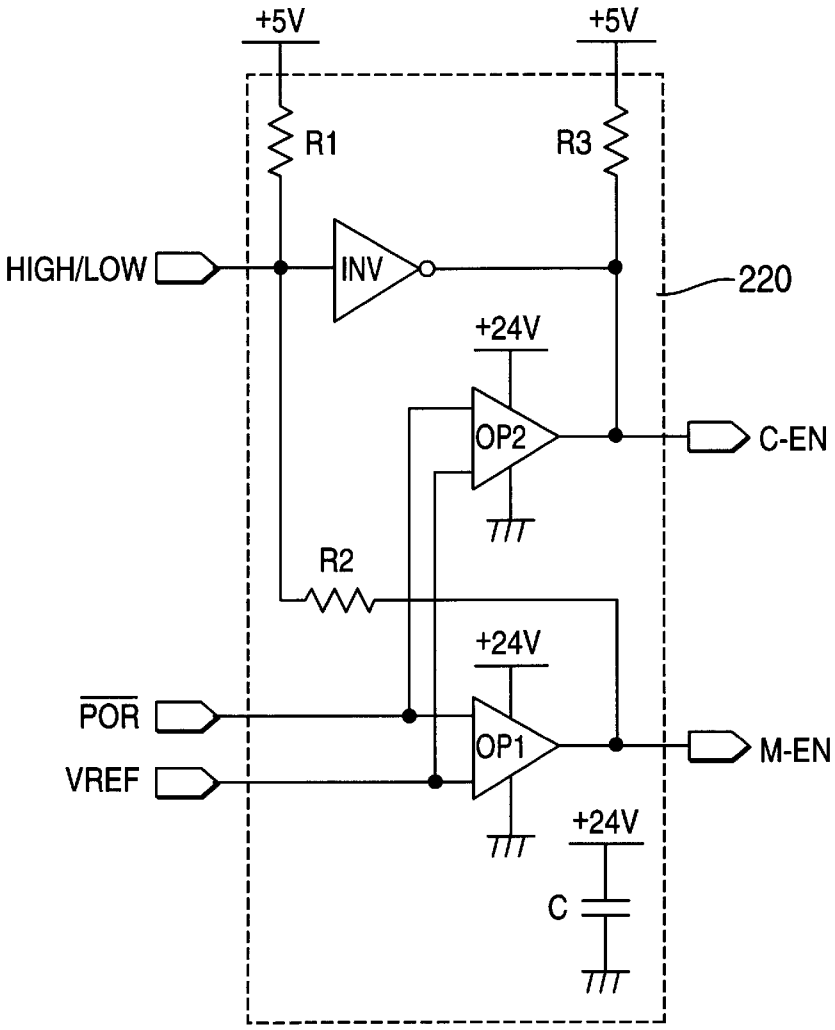
FIG. 6 is a circuit diagram according to a preferred embodiment of the head driver shown in FIG. 5, according to the principles of the present invention; and FIG, 7 is a circuit diagram according to a preferred embodiment of the sensing circuit in the ink cartridge shown in FIG. 5, according to the principles of the present invention.

Refer now to FIG. 6, which is a circuit diagram according to a preferred embodiment of the head driver shown in FIG. 5, according to the principles of the present invention. The circuit according to the preferred embodiment of the head driver 220 for driving the ink cartridge 221 will be described below with reference to FIG. 6.

In the head driver 220, a first operational amplifier OP1 receives a power reset signal POR with non-inverted terminal (+), a second operational amplifier OP2 receiving a reference voltage VREF with inverted terminal (−). The first and second operational amplifiers OP1 and OP2 generate a comparative voltage according to the power reset signal POR applied thereto.

When ASIC (application specific integrated circuit) 212 applies a "high" voltage as the ink cartridge select signal generated from the CPU 213, the voltage combines with the output voltage of the first operational amplifier OP1 through resistance R1 such that a black ink cartridge enable signal M-EN occurs for driving one black ink cartridge.

On the contrary, if ASIC 212 applies a "low" voltage as the ink cartridge select signal generated from the CPU 213, the voltage is inverted through an invertor INV and combines with the output voltage of the second operational amplifier OP2, generating a color ink cartridge enable signal C-EN occurs for driving the color ink cartridge.

At this stage, resistance R2 overlaps a voltage of +5 volts generated therefrom with the ink cartridge select signal, and capacitor C is used to eliminate noises while a voltage of +24 volts is supplied for driving the first and second operational amplifiers OP1 and OP2. As the operational amplifiers OP1 and OP2 are driven by the head driver 220, the ink cartridge sensor 217 determines the type of ink cartridge 221.

Figure 7:
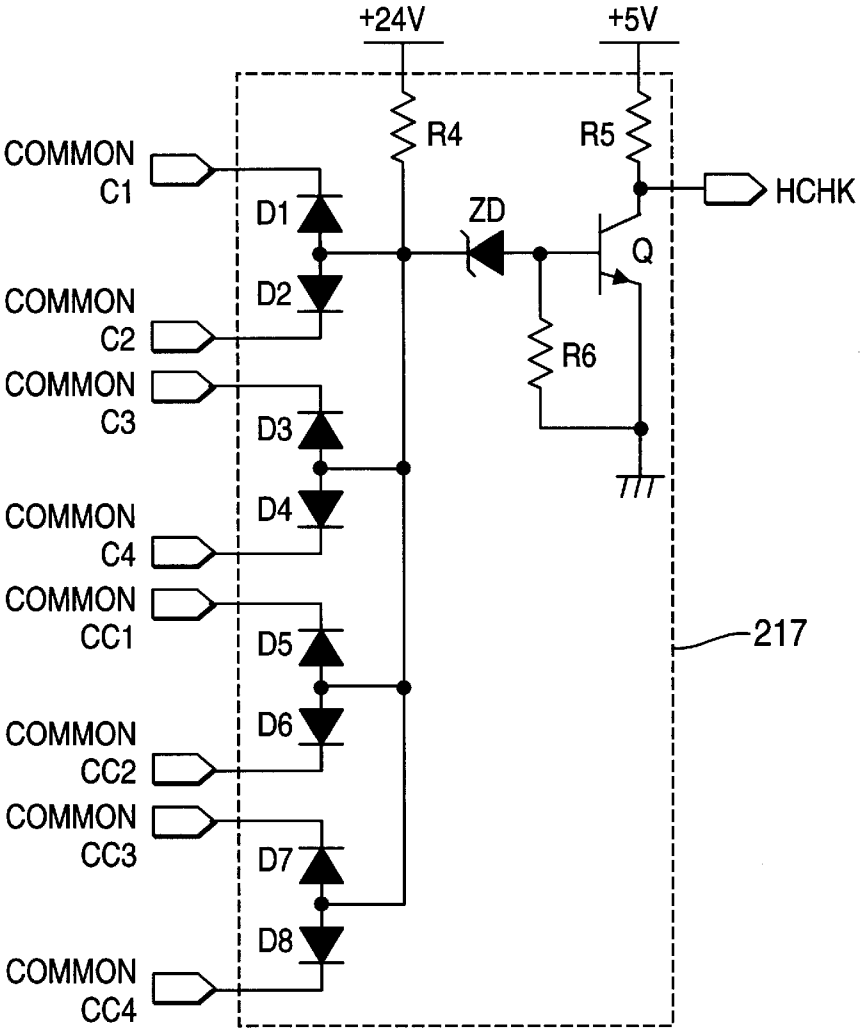

Refer now to FIG. 7, which is a circuit diagram according to a preferred embodiment of the sensing circuit in the ink cartridge shown in FIG. 5, according to the principles of the present invention. In FIG. 7, the ink cartridge sensor 217 of FIG. 5 is depicted. As shown in the FIG. 7, the ink cartridge sensor 217 generates an electrical signal, voltage (+24 volts) to ink cartridge 221 through resistance R4, applying it to common resistance COMMON C1–COMMON CC4 via diodes D1–D8.

Ink cartridge 221 jets ink droplets onto the print media with the voltage (+24 volts) applied to the respective nozzles through the common resistance COMMON C1–COMMON CC4. Transistor Q, which has received the current with its base from Zener diode ZD in response to the current flowing the common resistance COMMON C1–COMMON CC4, generates a checking signal HCHK according to driving the ink cartridge. Resistance R5 is used as a self-bias of the transistor Q and resistance R6 is used as a collector load.

The checking signal HCHK is applied to the CPU 213 through the ASIC 212, functioning as a signal to discriminate the type of ink cartridge 221. That is, as the black ink cartridge has 56 nozzles and the color one has 48 nozzles, the type of ink cartridge 221 is discriminated from the difference in number, eight nozzles, and the 48 nozzles common in two ink cartridges.

The Windows driver specially programmed is thus capable of recognizing the new ink cartridge replacing an old ink cartridge and generating print data dependent on the new ink cartridge even when the user replaces the old ink cartridge by pressing the ink replacement button disposed in the outer case of the ink jet printer.

Such as in the present invention as described above, the Windows driver senses the replacement of the ink cartridge in an automatic manner and generates print data adapted to the type of ink cartridge in case the user replaces the ink cartridge by pressing the ink replacement button disposed in an ink jet printer for the user's more efficient use.

The foregoing paragraphs describe the details of the present invention as it relates to driver software sensing an ink cartridge prior to the generation of print data and, more particularly, to driver software loaded on a host computer having a Microsoft Windows operating system, where the driver software senses the replacement of the ink cartridge in an automatic manner and generates print data adapted to the new type of ink cartridge when the user replaces the old type of ink cartridge by pressing an ink replacement button built in a 1-pen type ink jet printer.

It will be apparent to those skilled in the art that various modification and variations can be made in Windows driver for sensing an ink cartridge prior to generation of a print data according to the present invention without departing from the spirit or scope of the invention. Thus, it is intended that the present invention cover the modifications and variations of this invention provided they come within the scope of the appended claims and their equivalents.

What is claimed is:

1. A printing method for printing images on a printer connected to a host computer, said method comprising the steps of:

when a first ink cartridge of a printer is replaced by a second ink cartridge, transmitting a first signal to said printer from a host computer, and receiving a second signal from said printer to said host computer, said second signal including first data describing a pigment of ink contained in said second ink cartridge;

when said second signal is received by said host computer, identifying said pigment of said ink contained in said second ink cartridge;

when said pigment of said ink contained in said second ink cartridge corresponds to black ink, generating first print data corresponding to the black ink;

when said pigment of said ink contained in said second ink cartridge corresponds to different color inks, generating second print data corresponding to the different color inks, wherein a button mounted on said printer is pressed when said first ink cartridge of said printer is replaced by said second ink cartridge;

conveying said ink from said second ink cartridge onto a recordable medium to form a first image corresponding to said first print data when said first print data is generated;

conveying said ink onto the recordable medium to form a second image corresponding to said second print data when said second print data is generated, said conveying being performed when a head driver generates an electrical signal to said second ink cartridge;

receiving a reference voltage at said head driver, said head driver comprising first and second operational amplifiers, said first operational amplifier having an inverting input terminal receiving the reference voltage and a noninverting input terminal receiving a power signal and an output terminal;

receiving the reference voltage at said second operational amplifier, said second operational amplifier having an inverting input terminal receiving the reference voltage and a noninverting input terminal receiving the power signal and an output terminal;

when said first print data is generated, receiving a first voltage at said output terminal of said first operational amplifier and outputting a black ink enable signal driving said second ink cartridge; and when said second print data is generated, receiving a second voltage at said output terminal of said second operational amplifier and outputting a color ink enable signal driving said second ink cartridge.

2. The method of claim 1, said conveying corresponding jetting said ink from said second ink cartridge onto the recordable medium.

3. The method of claim 2, further comprising the steps of:

when said ink is identified as being the black ink, compressing said first print data;

when said ink is identified as being the different color inks, compressing said second print data;

transmitting a third signal to said printer from said host computer, and receiving a fourth signal from said printer to said host computer, said fourth signal including second data describing errors of said printer, said second data enabling a presence of errors in said printer to be identified;

when said fourth signal is received by said host computer, identifying said presence of said errors in said printer;

when said ink is identified as being the black ink, transmitting said first print data from said host computer to said printer; and when said ink is identified as being the different color inks, transmitting said second print data from said host computer to said printer.

4. The method of claim 3, wherein said printer corresponds to an inkjet printer.

5. The method of claim 3, further comprising driver software loaded on said host computer, said driver software communicating with said printer, performing said identifying of said pigment of said like contained in said second ink cartridge, performing said generating of said first print data when said ink is identified as being the black ink, and performing said generating of said second print data when said ink is identified as being the different color inks.

6. The method of claim 5, said driver software compressing said first print data, compressing said second print data, and identifying said presence of said errors in said printer.

7. The method of claim 6, further comprising a Microsoft Windows operating system loaded on said host computer.

8. The method of claim 2, the first voltage being different than the second voltage.

9. The method of claim 3, the second voltage being inverted before being received by said output terminal of said second operational amplifier.

10. A computer implemented method conveying attributes of an ink cartridge from a printer to a host computer, said method comprising the steps of:

when a first ink cartridge of said printer is replaced by a second ink cartridge, transmitting a first signal to said printer from said host computer, and receiving a second signal from said printer to said host computer, said second signal including attributes of said second ink cartridge;

when said second signal is received by said host computer, identifying said second ink cartridge;

when said second ink cartridge is identified as having a first attribute, generating first print data according to said first attribute;

when said second ink cartridge is identified as having a second attribute, generating second print data according to said second attribute;

conveying ink from said second ink cartridge onto a recordable medium to form a first image corresponding to said first print data when said first print data when said first print data is generated;

conveying said ink onto the recordable medium to form a second image corresponding to said second print data when said second print data is generated;

said conveying being performed when a head driver generates an electrical signal to said second ink cartridge;

receiving a reference voltage at said head driver, said head driver comprising first and second operational amplifiers, said first operational amplifier having an inverting input terminal receiving the reference voltage and a noninverting input terminal receiving a power signal and an output terminal;

receiving the reference voltage at said second operational amplifier, said second operational amplifier having an inverting input terminal receiving the reference voltage and a noninverting input terminal receiving the power signal and an output terminal;

when said first print data is generated, receiving a first voltage at said output terminal of said first operational amplifier and outputting a black ink enable signal driving said second ink cartridge; and when said second print data is generated, receiving a second voltage at said output terminal of said second operational amplifier and outputting a color ink enable signal driving said second ink cartridge, the first voltage being different than the second voltage.

11. The method of claim 10, wherein said first attribute of said second ink cartridge corresponds to black ink and said second attribute of said second ink cartridge corresponds to different color inks.

12. The method of claim 10, wherein an ink replacement button of said printer is pressed when replacing said first ink cartridge by said second ink cartridge.

13. The method of claim 10, further comprising the steps of:

when said second ink cartridge is identified as having said first attribute, compressing said first print data;

when said second ink cartridge is identified as having said second attribute, compressing said second print data;

transmitting a third signal to said printer from said host computer, and receiving a fourth signal from said printer to said host computer, said fourth signal including attributes of said printer;

when said fourth signal is received by said host computer, identifying presence of errors in said printer;

when said second ink cartridge is identified as having said first attribute, transmitting said first print data from said host computer to said printer; and when said second ink cartridge is identified as having said second attribute, transmitting said second print data from said host computer to said printer.

14. The method of claim 13, further comprising driver software loaded on said host computer, said driver software communicating with said printer, identifying said attributes of said second ink cartridge, generating said first print data when said second ink cartridge is identified as having said first attribute, and generating said second print data when said second ink cartridge is identified as having said second attribute.

15. The method of claim 14, said driver software compressing said first print data, compressing said second print data, and identifying said presence of said errors in said printer.

16. The method of claim 15, further comprising a Microsoft Windows operating system loaded on said host computer.

17. The method of claim 10, the first voltage corresponding to a voltage higher than the second voltage.

18. The method of claim 10, the second voltage being inverted before being received by said output terminal of said second operational amplifier.

19. The method of claim 12, the second voltage being inverted before being received by said output terminal of said second operational amplifier.

20. The method of claim 13, the second voltage being inverted before being received by said output terminal of said second operational amplifier.

21. A printing system for a printer connected to a host computer having a Microsoft Windows operating system, said printing system comprising:

a printer for recording an image onto a recordable medium;

a first ink cartridge containing ink and being connected to said printer;

a button mounted on said printer, said button being pressed when said first ink cartridge replaces a second ink cartridge;

a host computer being electrically connected to said printer, said host computer having a Microsoft Windows operating system;

driver software communicating with said printer when said first ink cartridge replaces the second ink cartridge and said button is pressed, identifying an attribute of said ink contained in said first ink cartridge when said attribute is transmitted to said driver software from said printer, and generating print data according to said identification of said attribute of said ink, said driver software being loaded on said host computer, wherein said attribute of said ink is a characteristic selected from the group consisting of monochrome ink and different color inks;

said first ink cartridge conveying said ink from said first ink cartridge onto a recordable medium to form a first image corresponding to the monochrome ink when said attribute of said ink corresponds to the monochrome ink, and conveying said ink onto the recordable medium to form a second image corresponding to the different color inks when said attribute of said ink corresponds to the different color inks;

a head driver, said conveying being performed in response to said head driver generating an electrical signal to said first ink cartridge, said head driver further comprising:

a first operational amplifier, said first operation amplifier having an inverting input terminal receiving the reference voltage and a noninverting input terminal receiving a power signal and an output terminal;

a second operational amplifier, said second operational amplifier having an inverting input terminal receiving the reference voltage and a noninverting input terminal receiving the power signal and an output terminal;

when said first print data is generated, said output terminal of said first operational amplifier receiving a first voltage and outputting a black ink enable signal driving said second ink cartridge; and when said second print data is generated, said output terminal of said second operational amplifier receiving a second voltage and outputting a color ink enable signal driving said second ink cartridge.

22. The printing system of claim 21, said driver software compressing said print data, and identifying a presence of errors in said printer.

23. The printing system of claim 21, the second voltage being inverted before being received by said output terminal of said second operational amplifier.

24. The printing system of claim 23, wherein monochrome corresponds to black.

25. The printing system of claim 23, wherein said print data generated according to said identification of said attribute of said ink corresponds to color print data when said attribute of said ink corresponds to the different color inks.

26. The printing system of claim 24, wherein said print data generated according to said identification of said attribute of said ink corresponds to black print data when said attribute of said ink corresponds to the black ink.

27. The system of claim 22, the second voltage being inverted before being received by said output terminal of said second operational amplifier.

28. The system of claim 23, the first voltage corresponding to a voltage higher than the second voltage.

29. The system of claim 25, said driver software compressing said print data, and identifying a presence of errors in said print.

30. A printing method for printing images on a printer connected to a host computer, said method comprising the steps of:

when a first ink cartridge of a printer is replaced by a second ink cartridge, transmitting a first signal to said printer from a host computer, and receiving a second signal from said printer to said host computer, said second signal including first data describing a pigment of ink contained in said second ink cartridge;

when said second signal is received by said host computer, identifying said pigment of said ink contained in said second ink cartridge;

when said pigment of said ink contained in said second ink cartridge corresponds to black ink, generating first print data corresponding to the black ink;

when said pigment of said ink contained in said second ink cartridge corresponds to different color inks, generating second print data corresponding to the different color inks;

conveying said ink from said second ink cartridge onto a recordable medium to form a first image corresponding to said first print data when said first print data is generated;

conveying said ink onto the recordable medium to form a second image corresponding to said second print data when said second print data is generated, said conveying being performed when a head driver generates an electrical signal to said second ink cartridge;

receiving a reference voltage at said head driver, said head driver comprising first and second operational amplifiers, said first operational amplifier having an inverting input terminal receiving the reference voltage and a noninverting input terminal receiving a power signal and an output terminal;

receiving the reference voltage at said second operational amplifier, said second operational amplifier having an inverting input terminal receiving the reference voltage and a noninverting input terminal receiving the power signal and an output terminal;

when said first print data is generated, receiving a first voltage at said output terminal of said first operational amplifier and outputting a black ink enable signal driving said second ink cartridge; and when said second print data is generated, receiving a second voltage at said output terminal of said second operational amplifier and outputting a color ink enable signal driving said second ink cartridge, the first voltage being different than the second voltage.

31. The method of claim 30, said conveying corresponding to jetting said ink from said second ink cartridge onto the recordable medium.

32. The method of claim 30, the first voltage corresponding to a voltage higher than the second voltage.

33. The method of claim 30, the second voltage being inverted before being received by said output terminal of said second operational amplifier.

34. A printing system for a printer connected to a host computer having a Microsoft Windows operating system, said printing system comprising:

a printer for recording an image onto a recordable medium;

a first ink cartridge containing ink and being connected to said printer;

a button mounted on said printer, said button being pressed when said first ink cartridge replaces a second ink cartridge;

a host computer being electrically connected to said printer, said host computer having a Microsoft Windows operating system;

driver software communicating with said printer when said first ink cartridge replaces the second ink cartridge and said button is pressed, identifying an attribute of said ink contained in said first ink cartridge when said attribute is transmitted to said driver software from said printer, and generating print data according to said identification of said attribute of said ink, said driver software being loaded on said host computer;

wherein said attribute of said ink is a characteristic selected from the group consisting of monochrome ink and different color inks;

said first ink cartridge conveying said ink from said first ink cartridge onto a recordable medium to form a first image corresponding to the monochrome ink when said attribute of said ink corresponds to the monochrome ink, and conveying said ink onto the recordable medium to form a second image corresponding to the different color inks when said attribute of said ink corresponds to the different color inks;

a head driver, said conveying being performed in response to said head driver generating an electrical signal to said first ink cartridge, said head driver further comprising:

a first operational amplifier, said first operation amplifier having an inverting input terminal receiving the reference voltage and a noninverting input terminal receiving a power signal and an output terminal;

a second operational amplifier, said second operational amplifier having an inverting input terminal receiving the reference voltage and a non inverting input terminal receiving the power signal and an output terminal;

when said first print data is generated, said output terminal of said first operational amplifier receiving a first voltage and outputting a black ink enable signal driving said second ink cartridge; and when said second print data is generated, said output terminal of said second operational amplifier receiving a second voltage and outputting a color ink enable signal driving said second ink cartridge, the first voltage being different than the second voltage.

35. The system of claim 34, the first voltage corresponding to a voltage higher than the second voltage.

36. The system of claim 34, the second voltage being inverted before being received by said output terminal of said second operational amplifier.

* * * * *